US005927095A

United States Patent [19]

Lee

[11] Patent Number: 5,927,095

[45] Date of Patent: Jul. 27, 1999

[54] ANTI-FROST DEVICE FOR REFRIGERATORS

[75] Inventor: Myung Ju Lee, Changwon, Rep. of Korea

[73] Assignee: LG Electronics, Inc., Seoul, Rep. of Korea

[21] Appl. No.: 09/075,248

[22] Filed: May 11, 1998

[30] Foreign Application Priority Data

May 20, 1997 [KR] Rep. of Korea ..... 97-11256
Aug. 8, 1997 [KR] Rep. of Korea ..... 97-21750

[51] Int. Cl.[6] ..... F25D 21/06

[52] U.S. Cl. ..... 62/275; 62/273; 62/277

[58] Field of Search ..... 62/407, 440, 275, 62/277, 273

[56] References Cited

U.S. PATENT DOCUMENTS 3,149,476 9/1964 Beckwith ..... 62/275
3,371,503 3/1968 Perez ..... 62/277
4,197,718 4/1980 Abraham et al. ..... 62/248
4,903,501 2/1990 Harl ..... 62/187
5,584,191 12/1996 Kwon ..... 62/417
5,657,636 8/1997 Suggs ..... 62/80

*Primary Examiner*—William Doerrler
*Attorney, Agent, or Firm*—Birch, Stewart, Kolasch & Birch, LLP

[57] ABSTRACT

An anti-frost device for refrigerators includes a heating mechanism capable of preventing any frost from being formed at the outlet portion of a cool air distribution duct, thus allowing cool air to effectively circulate in the cabinet of a refrigerator. The heating mechanism may be a pipe passing over the outlet portion of the distribution duct and allowing a high temperature refrigerant from a refrigeration cycle to pass through. Alternatively, the heating means may be an electric heating wire wound around the outlet portion of the distribution duct.

10 Claims, 3 Drawing Sheets

ANTI-FROST DEVICE FOR REFRIGERATORS

BACKGROUND OF THE INVENTION

1. Field of the Invention

The present invention relates, in general, to an anti-frost device for refrigerators and, more particularly, to an anti-frost device provided with a heating means capable of preventing any frost from being formed at the outlet portion of a cool air distribution duct.

2. Description of the Prior Art

As well known to those skilled in the art, a refrigerator is used for preserving food and drink at cool temperatures for a lengthy period of time. Such a refrigerator comprises a refrigeration cycle system, which includes a condenser, compressor, capillary tube and evaporator and generates cool air. The cool air is distributed to all sides of the refrigerator.

FIG. 1 is a sectional view illustrating the construction and a cool air circulation of a refrigerator in accordance with the prior art.

As shown in the drawing, the typical refrigerator comprises a cabinet 1, opening at the front portion, and a door 3 hinged to a side wall of the cabinet 1. The cabinet 1 has a storing cavity 2, defined in the interior and used for preserving food and drink. In addition, the cavity 2 is typically divided into two compartments: freezer and refrigeration compartments.

With reference to FIG. 1, a cool air duct 6 is defined in the rear wall of the cabinet 1, while an evaporator 5 is mounted in the cool air duct 6. A plurality of first discharging holes 6*a* are formed at a partition wall between the cool air duct 6 and the cavity 2. A door duct 8 is provided in the door 3 and communicates with the cavity 2 through a plurality of second discharging holes 8*a*. Also, a cool air distribution duct 7 is provided in a side wall of the cabinet 1 and connects the cool air duct 6 to the door duct 8.

In FIG. 1, the reference numeral 3*a* denotes a gasket member, which is attached along the edge of the door 3 in order to prevent an unexpected leakage of cool air from the cavity 2 into the atmosphere or prevent an unexpected introduction of hot air from surroundings into the cavity 2 when the door 3 is closed. In addition, an anti-frost pipe 9 is set in the front edge of the cabinet 1. The above anti-frost pipe 9 allows high temperature refrigerant from the condenser to pass through, thus preventing the front edge of the cabinet 1 from being wet with dew in a high temperature and high humidity atmosphere.

The function of the above refrigerator will be described below.

As shown in FIG. 1, a liquid refrigerant, having low temperature and low pressure, is quickly vaporized in the evaporator 5 while absorbing heat from air in the cabinet 1, thus forming cool air to be circulated in the cabinet 1. The cool air is partially discharged from the duct 6 into the cavity 2 through the first discharging holes 6*a* and partially flows from the duct 6 into the distribution duct 7 as shown by the dotted arrow in FIG. 1. The cool air, introduced into the distribution duct 7, flows into the door duct 8 through the outlet of the distribution duct 7 prior to being discharged into the cavity 2 through the second discharging holes 8*a*.

However, the above refrigerator is problematic in that it is somewhat difficult for the cool air to smoothly circulate in the cabinet 1 due to frost formed at the outlet portion of the distribution duct 7, thus reducing the cooling efficiency of the refrigerator.

In a brief description, when the door 3 is opened, hot air flows from the atmosphere into the cavity 2 as shown by the solid arrow of FIG. 2, thus meeting the cool air, which has a low temperature less than that of the hot air. The inner surface of the cabinet 1 is thus wet with dew.

In particular, dewdrops are formed at the outlet portion of the distribution duct 7 because there is a wide temperature difference between the hot and cool air at the outlet portion of the distribution duct 7.

When the door 3 at the above position is closed, the temperature of the cavity 2 is dropped by a predetermined degree. Therefore, the dew, formed on the inner surface of the cabinet 1, turns into frost. Particularly, the dewdrops, formed at the outlet portion of the distribution duct 7, rapidly turn into frost during the circulation of cool air in the duct 7. When the door 3 is repeatedly opened and closed, such a frost formation is repeated, thus causing the outlet portion of the distribution duct 7 to be covered with frost.

It is thus difficult for cool air to smoothly circulate in the cavity 2, so the cooling efficiency of the refrigerator is reduced. Furthermore, in order to forcibly circulate the cool air, the cooling function of the refrigerator has to operate for extended periods of time, thus causing excessive electric power consumption.

In addition, such frost may be formed at the outlet portion of the cool air duct 6 or the door duct 8 as well as the distribution duct 7.

SUMMARY OF THE INVENTION

Accordingly, the present invention has been made keeping in mind the above problems occurring in the prior art, and an object of the present invention is to provide an anti-frost device for refrigerators, which has a heating means capable of preventing any frost from being formed at the outlet portion of a cool air distribution duct, thus allowing cool air to effectively circulate in the cabinet and increasing the cooling efficiency, and reducing electric power consumption of the refrigerators.

In order to accomplish the above object, the present invention provides an anti-frost device for refrigerators, comprising: means for supplying cool air to a storing cavity of a refrigerator; a cool air distribution duct connected to the cool air supplying means and adapted for distributing the cool air from the supplying means to a door of the refrigerator; a door duct defined in the door and selectively connected to the distribution duct, thus discharging the cool air into the cavity; and heating means provided around an outlet portion of the distribution duct, thus emitting heat to the outlet portion of the distribution duct.

In an embodiment, the heating means comprises a pipe passing over the outlet portion of the distribution duct and allowing a high temperature refrigerant from a refrigeration cycle to pass through.

In another embodiment, the heating means comprises an electric heating wire wound around the outlet portion of the distribution duct.

The above anti-frost device effectively prevents any frost from being formed at the outlet portion of the cool air distribution duct.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
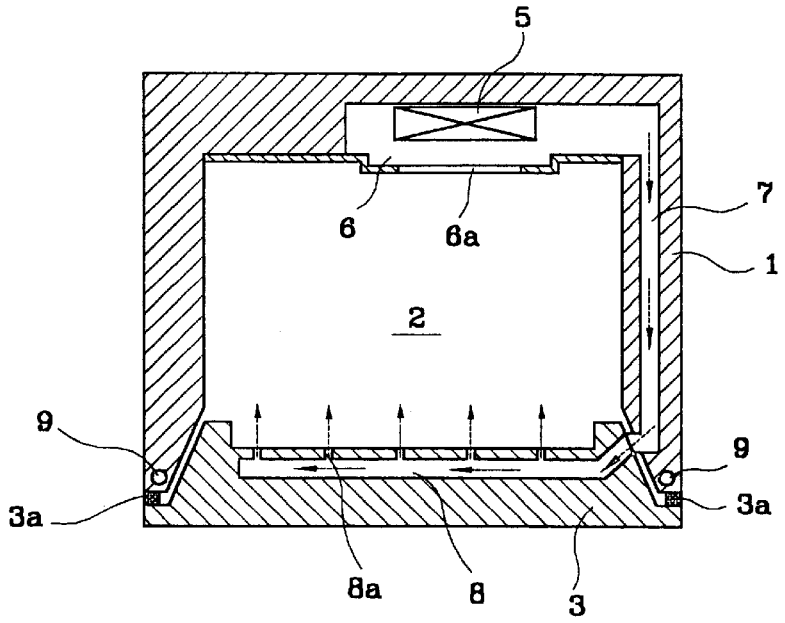
FIG. 1 is a cross-sectional view of a refrigerator in accordance with the prior art, showing cool air circulation in the storing cavity when the door is closed.
Figure 2:
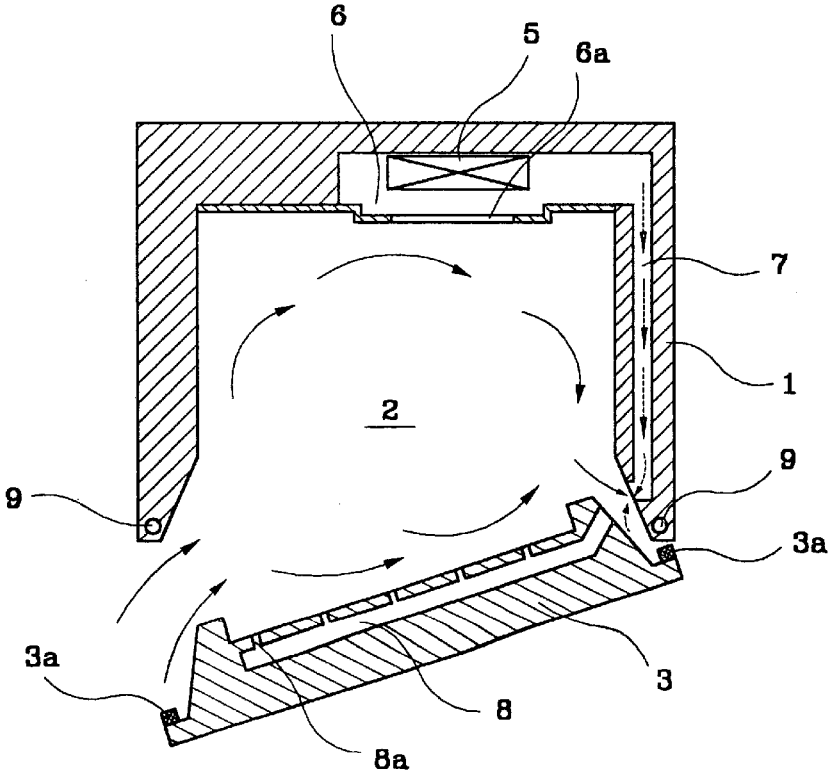
FIG. 2 is a cross-sectional view of the refrigerator of FIG. 1, showing hot and cool air circulation in the cavity when the door is open.
Figure 3:
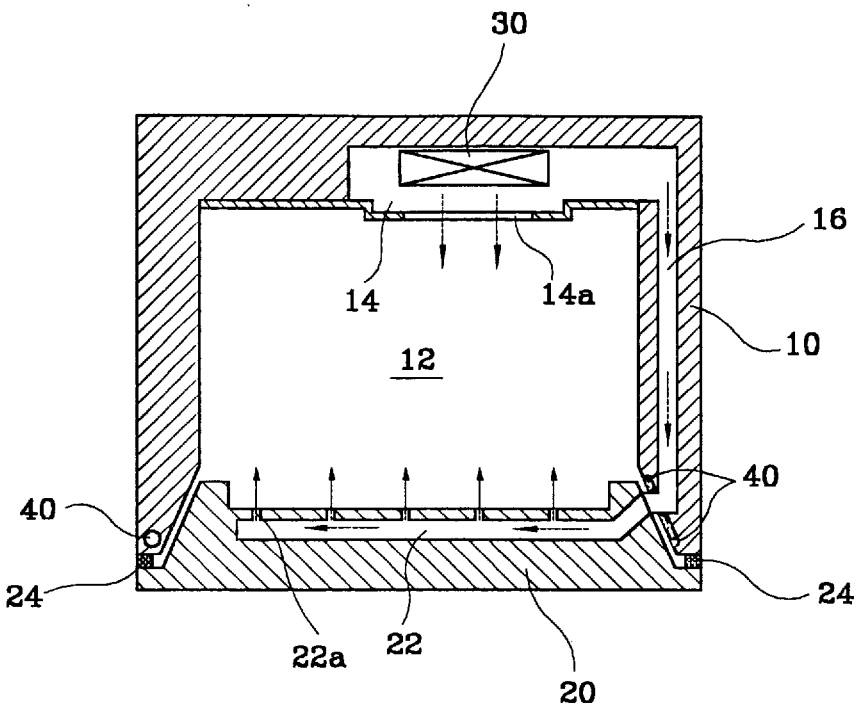
FIG. 3 is a cross-sectional view of a refrigerator provided with an anti-frost device in accordance with the primary embodiment of the present invention, showing a cool air circulation in the cavity when the door is closed.
Figure 4:
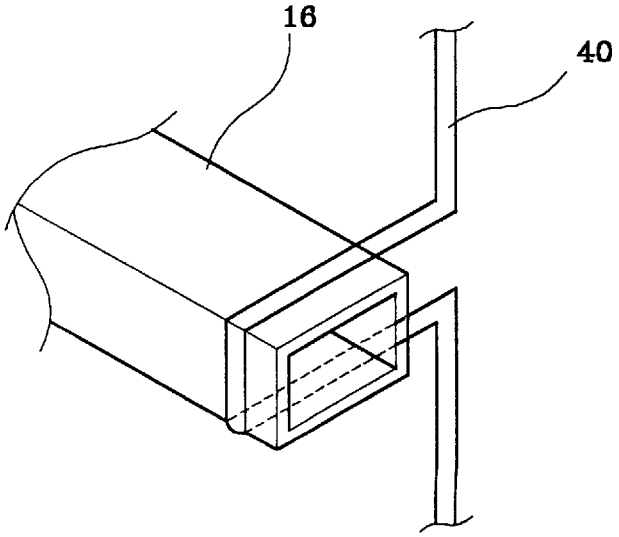
FIG. 4 is an exploded perspective view of the anti-frost device of FIG. 3.

FIGS. 3 and 4 are views illustrating an anti-frost device for refrigerators in accordance with the primary embodiment of the present invention.

As shown in FIGS. 3 and 4, the refrigerator comprises a cabinet 10, opening at the front portion, and a door 20 hinged to a side wall of the cabinet 10. The cabinet 10 has a storing cavity 12, defined in the interior and used for preserving food and drink. In addition, the cavity 12 is divided into two compartments: freezer and refrigeration compartments. Of course, a separated compartment, having temperature and humidity different from those of the cavity 12, may be formed in the cabinet 10.

A cool air duct 14 is defined in the rear wall of the cabinet 10, while an evaporator 30 is mounted in the cool air duct 14. A plurality of first discharging holes 14*a* are formed at a partition wall between the cool air duct 14 and the cavity 12. A door duct 22 is provided in the door 20 and communicates with the cavity 12 through a plurality of second discharging holes 22*a*. Also, a cool air distribution duct 16 is provided in a side wall of the cabinet 10 and connects the cool air duct 14 to the door duct 22. A gasket member 24 is attached along the edge of the door 20 in order to prevent a leakage of cool air from the cavity 12 or prevent hot air from being introduced into the cavity 12 when the door 20 is closed.

In addition, the cabinet 10 is provided with an anti-frost device comprising a heating means capable of preventing any frost from being formed at the outlet of the distribution duct 16. In the primary embodiment, the heating means comprises an anti-frost pipe 40 which is set in the front edge of the cabinet 10. The above anti-frost pipe 40 is connected to a condenser (not shown) and a capillary tube (not shown) at both ends. The anti-frost pipe 40 thus allows high temperature refrigerant from the condenser to pass through, so the pipe 40 prevents the front edge of the cabinet 10 from being wet with dew.

The anti-frost pipe 40 is bent at a portion around the distribution duct 16, thus surrounding the outside of the duct 16 as shown in FIG. 4. That is, the anti-frost pipe 40 surrounds the outlet portion of the distribution duct 16 and allows high temperature refrigerant from the condenser to pass through. Due to the high temperature refrigerant, the anti-frost pipe 40 emits heat and eliminates any dewdrops from the outlet portion of the distribution duct 16, thus almost completely preventing a formation of frost at the outlet portion of the duct 16.

Figure 5:
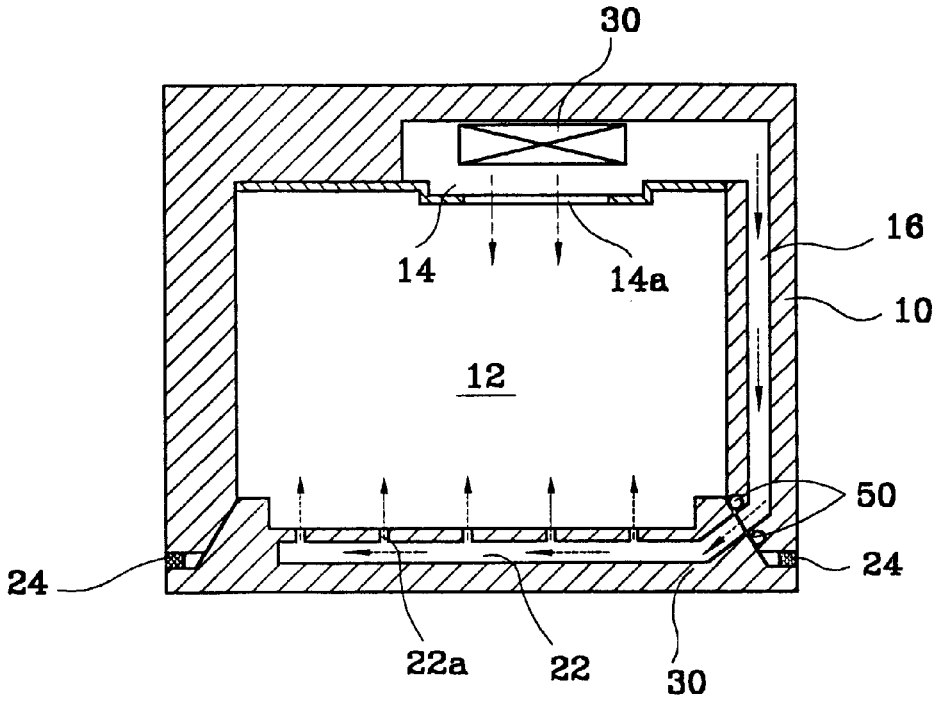
FIG. 5 is a cross-sectional view of a refrigerator provided with an anti-frost device in accordance with the second embodiment of the present invention, showing cool air circulation in the cavity when the door is closed.

FIG. 5 is view illustrating an anti-frost device for refrigerators in accordance with the second embodiment of the present invention. In the second embodiment, the heating means of the anti-frost device comprises a heating wire 50 which is set in the cabinet 10 at a position around the distribution duct 16. That is, the heating wire 50 is wound around the outlet portion of the distribution duct 16. The above heating wire 50 may be designed for being turned on by electric power of the refrigerator or a separate electric power source. In this embodiment, the heating wire 50 emits heat at all times or at regular intervals when the refrigerator is turned on.

The function of the above refrigerator of this invention is described below.

As shown in FIGS. 3 and 5, a liquid refrigerant, having low temperature and low pressure, is quickly vaporized in the evaporator 30 while absorbing heat from air in the cabinet 10, thus forming cool air to be circulated in the cabinet 10. The cool air is partially discharged from the duct 14 into the cavity 12 through the first discharging holes 14*a* as shown by the dotted arrow in the drawings.

The cool air also partially flows from the duct 14 into the distribution duct 16. The cool air, introduced into the distribution duct 16, flows into the door duct 22 through the outlet of the distribution duct 16 prior to being discharged into the cavity 12 through the second discharging holes 22*a*.

When the door 20 is opened, hot air from the atmosphere flows into the cavity 12. The hot air thus meets the cool air, which has a lower temperature less than that of the hot air. In this case, dewdrops may be formed at the outlet portion of the distribution duct 16. However, heat, emitted from the anti-frost pipe 40 or the heating wire 50, prevents such dewdrops from being formed at the outlet portion of the distribution duct 16. It is thus possible to prevent any frost from being formed at the outlet portion of the distribution duct 16.

In the second embodiment, frost is not formed around the outlet portion of the distribution duct 16 due to the heating wire 50 which intermittently emits heat at regular intervals as an evaporator performs a defrosting operation.

As mentioned above, an anti-frost device for refrigerators of this invention is provided with a heating means capable of preventing any frost from being formed at the outlet portion of a cool air distribution duct, thus allowing cool air to effectively circulate in the refrigerator and increasing the cooling efficiency, and reducing the electric power consumption of the refrigerator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An anti-frost device for refrigerators, comprising:

means for supplying cool air to a storing cavity of a refrigerator;

a cool air distribution duct connected to said cool air supplying means and adapted for distributing the cool air from said supplying means to a door of the refrigerator;

a door duct defined in the door and selectively connected to said distribution duct, thus discharging the cool air into the cavity; and heating means provided around an outlet portion of said distribution duct, thus emitting heat to the outlet portion of said distribution duct.

2. The anti-frost device as claimed in claim 1, wherein said heating means comprises a pipe passing over the outlet portion of the distribution duct and allowing a high temperature refrigerant from a refrigeration cycle to pass through.

3. The anti-frost device as claimed in claim 1, wherein said heating means comprises an electric heating wire wound around the outlet portion of the distribution duct.

4. An anti-frost device for refrigerators, comprising:

means for supplying cool air to a storing cavity of a refrigerator;

a cool air distribution duct connected to said cool air supplying means for distributing the cool air from said supplying means to a door of the refrigerator;

a door duct defined in the door and selectively connected to said distribution duct for discharging the cool air into the storing cavity; and a heating device extending around an outside surface of an outlet portion of said distribution duct, said heating means covering at least a top, a bottom and a side of said outlet portion.

5. The anti-frost device as claimed in claim 4, wherein said heating device includes a pipe for carrying a high temperature refrigerant therethrough.

6. The anti-frost device as claimed in claim 4, wherein said heating device includes an electric heating wire wound around the outlet portion of the distribution duct.

7. The anti-frost device as claimed in claim 4, wherein said outlet portion of said distribution duct directly engages an inlet portion of said door duct.

8. The anti-frost device as claimed in claim 1, wherein said outlet portion of said distribution duct directly engages an inlet portion of said door duct.

9. The anti-frost device as claimed in claim 5, wherein said pipe is a bent portion of an anti-frost pipe of the refrigerator, said anti-frost pipe is located on opposite sides of a door opening of the refrigerator.

10. The anti-frost device as claimed in claim 2, wherein said pipe is a bent portion of an anti-frost pipe of the refrigerator, said anti-frost pipe is located on opposite sides of a door opening of the refrigerator.

* * * * *